United States Patent [19]

Imamura et al.

[11] Patent Number: 4,835,440

[45] Date of Patent: May 30, 1989

[54] FLUORESCENT LAMP GENERATING DIFFERENT COLOR LIGHT BEAMS

[75] Inventors: Hitoshi Imamura, Yokohama; Junichi Nakajima, Tokyo, both of Japan

[73] Assignees: Kabushiki Kaisha Toshiba, Kawasaki; Toshiba Electric Equipment Corporation, Tokyo, both of Japan

[21] Appl. No.: 113,127

[22] Filed: Oct. 27, 1987

[30] Foreign Application Priority Data

| | | | |
|---|---|---|---|
| Oct. 31, 1986 | [JP] | Japan | 61-260008 |
| Dec. 27, 1986 | [JP] | Japan | 61-311181 |
| Mar. 3, 1987 | [JP] | Japan | 62-46823 |
| Mar. 3, 1987 | [JP] | Japan | 62-46824 |

[51] Int. Cl.[4] ..... H01J 61/067; H01J 61/10; H01J 61/44

[52] U.S. Cl. ..... 313/492; 313/493; 313/602; 313/610

[58] Field of Search ..... 313/493, 495, 610, 619, 313/485, 602, 601, 492

[56] References Cited

U.S. PATENT DOCUMENTS

| | | | |
|---|---|---|---|
| 1,787,689 | 1/1931 | Lederer | 313/602 X |
| 2,945,977 | 7/1960 | Schonherr | 313/493 X |
| 3,934,172 | 1/1976 | Okamoto | 313/485 X |

FOREIGN PATENT DOCUMENTS

| | | | |
|---|---|---|---|
| 554213 | 3/1958 | Canada | 313/602 |
| 0127475 | 12/1984 | European Pat. Off. . | |
| 851362 | 9/1985 | Japan . | |
| 61-141763 | 9/1986 | Japan . | |
| 0224255 | 10/1986 | Japan | 313/485 |
| 456402 | 11/1936 | United Kingdom . | |
| 571111 | 8/1945 | United Kingdom . | |
| 619721 | 3/1949 | United Kingdom . | |
| 2145873 | 4/1985 | United Kingdom . | |
| 2167895 | 6/1986 | United Kingdom . | |

*Primary Examiner*—Palmer C. DeMeo
*Attorney, Agent, or Firm*—Cushman, Darby & Cushman

[57] ABSTRACT

A cathode is arranged at one end of an envelope of a fluorescent lamp, and a plurality of anodes are arranged at the other end. A discharge path-forming structure is disposed between the cathode and anodes. The structure comprises a vessel having an open end at the position adjacent to the anodes and an inner space, and also comprises a dividing element for dividing the inner space into a plurality of divided discharge paths each including a corresponding anode. A fluorescent material layer is coated on the inner surface of the vessel in a manner whereby the lamp generates different color light beams.

15 Claims, 10 Drawing Sheets

FLUORESCENT LAMP GENERATING DIFFERENT COLOR LIGHT BEAMS

BACKGROUND OF THE INVENTION

The present invention relates to a fluorescent lamp and, more particularly, to a fluorescent lamp which can generate different colour light beams.

A fluorescent lamp of this type can emit, by means of only a single lamp, a plurality of different coloured light beams, and is adapted to construct a colour display device, using the lamp as a display element.

At first, the construction of a conventional color display device will be described.

A first means forms one picutre element of three display elements emitting, for example, red, blue and green, respectively, and performs a colour display by arranging a plurality of those picture elements. It is apparent that the first means includes a number of display elements so that the attachments and maintenance of the display elements are difficult and its display surface cannot be enhanced in density. To eliminate the drawbacks, a second means in FIG. 1 and third means in FIG. 2 have been proposed in Japanese Utility Model Disclosure Sho 61-141763. In FIG. 1, transparent envelope 1 made, for example, of glass has a display end, i.e., light beam transmitting end 1a and electrode sealing end 1b. The inner space of envelope 1 itself is divided by partition member 2 into three parallel discharge paths A, B, C. Each discharge path has anode 3, and is so constructed as to generate a discharge between selected anode 3 and common cathode 4. A fluorescent material layer having different light emitting characteristics at parallel discharge paths is provided on the inner surface of envelope 1 which forms parallel discharge paths A, B, C. Therefore, a number of colours can be displayed by selectively energizing anodes 3. Since partition member 2 divides the inner space itself of envelope 1, the probability of generating colour noises is large. It is further very difficult to provide fluorescent material layers of a plurality of colours on the inner surface of envelope 1 to match the position of partition member 2. In a display element in FIG. 2, three cylindrical partition walls 5 are arranged in the transparent envelope 1. Anodes 3 are provided at the side of beam transmitting end 1a to selectively generate a discharge between a common cathode 4 and a selected anode 3. The inner surfaces of cylindrical partition wall 5 are respectively coated with fluorescent material layers emitting different colours. In FIG. 2, since a fluorescent material layer is not arranged on the inner surface of envelope 1, a difficulty of arranging fluorescent material layers like a display element in FIG. 1 is eliminated. However, since fluorescent material layers formed on the inner surfaces of partition walls 5 are parallel to the center axis, it has such a drawback that the fluorescent material layers cannot be directly observed. Since three cylindrical partition walls 5 are arranged in envelope 1, a dead space exists among three partition walls 5 and the effective light emitting area as observed from the extension of the center axis is reduced. As a result, it has such a drawback that colour noises are increased.

SUMMARY OF THE INVENTION

Accordingly, an object of the present invention is to provide a fluorescent lamp generating different colour light beams which comprises a single envelope and a plurality of fluorescent material layers capable of generating a plurality of different colour light beams and particularly being readily arranged and which has a large light-emitting area.

According to the present invention, there is provided a fluorescent lamp generating different colour light beams comprising: an envelope enclosing therein a discharge substance; first and second electrode means specially arranged in the envelope; a discharge path forming structure comprising a vessel located between the first electrode means and the second electrode means and having an open end adjacent to the first electrode means and a dividing element for dividing an inner area defined by an inner surface of the vessel to form a plurality of divided discharge paths developed between the first and second electrode means; and a fluorescent material layer coated on the inner surface of the vessel.

DETAILED DESCRIPTION OF THE PREFERRED EMBODIMENTS

Figure 3:
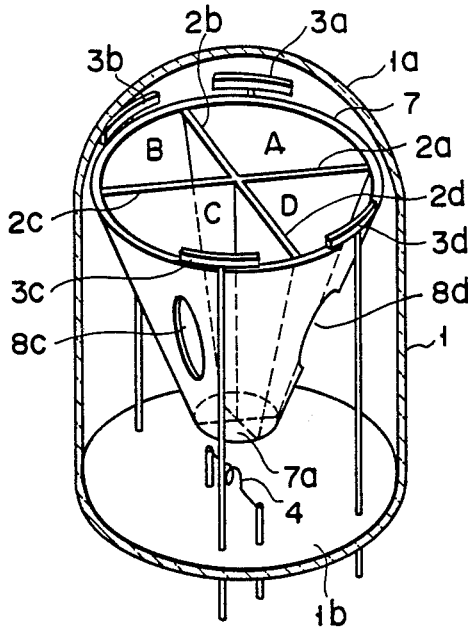
FIG. 3 is a perspective view showing partly in section the inner structure of a fluorescent lamp according to a first embodiment of the present invention.
Figure 4:
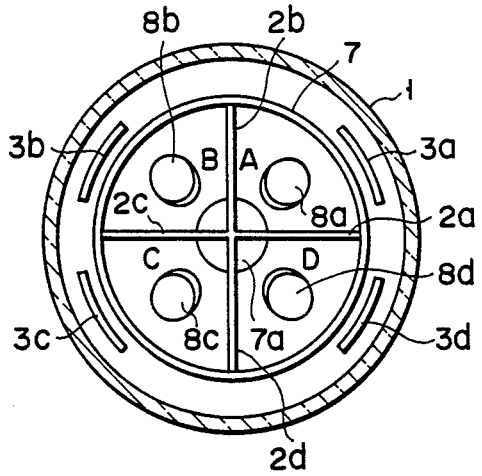
FIG. 4 is a plan view showing in section a light beam transmitting end of FIG. 3.

FIG. 3 shows a fluorescent lamp adapted for a display element. Envelope 1 is formed of a transparent material, for example, a glass, and has light beam transmitting end **1*a* and electrode sealing end 1*b*. In sealing end 1*b* is arranged a common cathode 4 (second electrode means), and in beam transmitting end 1*a* is arranged four anodes 3*a* to 3*d* (first electrode means). These cathode and anodes are connected to conductive members sealed at electrode sealing end 1***b* to be connected to an external power source. Between cathode 4 and anodes 3*a* to 3*d* is arranged a vessel 7 of a discharge path forming structure made, for example, of a metal having a truncated inner space. In the embodiment described above, the cathode is used as second electrode means, the anodes are used as first electrode means, and a DC voltage is applied between the cathode and the anodes to generate a DC discharge. However, an AC voltage may be, of course, applied between the first electrode means and the second electrode means to generate an AC discharge. The vessel 7 is supported by a support member, not shown, sealed at electrode sealing end 1*b*. The inner space of vessel 7 defines the configuration of a discharge path for generating discharge between the cathode and the anodes, and is divided by the portions 2*a* to 2*d* of a dividing element (a partition member) into four divided discharge paths (parallel discharge paths) A to D. The larger diameter end portion of the vessel 7 is opened at light beam transmitting end 1*a* and the smaller end portion is closed by plate 7*a* at cathode 4. A plurality of discharge current passing holes 8*a* to 8*d* are formed at the side portion of the vessel. The inner surfaces of parallel discharge paths A to D, i.e., the inner surface of vessel 7 and the surfaces of portions 2*a* to 2*d* of partition member are coated with flourescent material layers. Here, the inner surface of parallel discharge path A is coated with a green colour beam emitting fluorescent material layer, the inner surface of parallel discharge path B is coated with a blue colour beam emitting fluorescent material layer, the inner surface of parallel discharge path C is coated with a green colour beam emitting fluorescent material layer, and the inner surface of parallel discharge path D is coated with red colour beam emitting fluorescent material layer. Here, it makes the entire picture element bright to coat the parallel discharge paths A, C with the green colour beam emitting fluorescent material layer.

Figure 1:
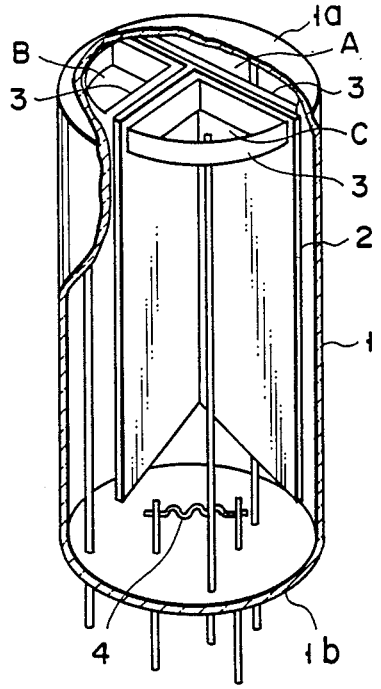
FIG. 1 (PRIOR ART)
FIGS. 1 and 2 are perspective views showing partly in section a prior art fluorescent lamp generating different colour light beams.
Figure 2:
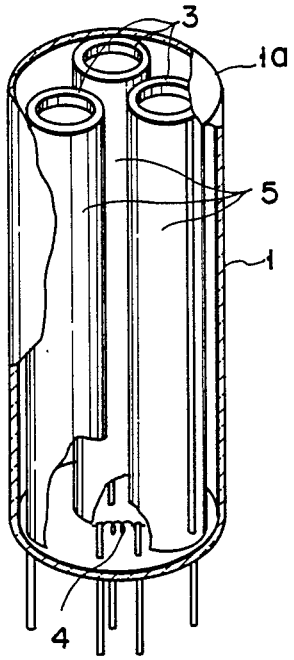
FIG. 2 (PRIOR ART)

In FIG. 3, when cathode 4, i.e., filament coil is energized and an anode voltage is selectively applied to one of anodes 3*a* to 3*d*, a discharge current flows to the selected parallel discharge path corresponding to the selected anode, and light beams of light emitting characteristics of the fluorescent material layer coated on the parallel discharge path is observed from light beam transmitting end 1*a*. In this first embodiment, since the inner surface of vessel 7 is inclined with respect to the center axis of envelope 1 connecting the center of light beam transmitting end 1*a* to that of electrode sealing end 1*b*, the beam emitted from fluorescent material layer can be directly observed when the fluorescent lamp is used as a display element. Therefore, a character or a picture image can be clearly identified. The fluorescent material layer is not coated on the inner surface of envelope 1. Therefore, it is not necessary to coat a fluorescent material layer on the inner surface of the envelope while regulating the coating position. More specifically, the fluorescent material layer may be coated only on the inner surface of vessel 7 and partition member 2, and coatings of different colour beam emitting fluorescent material layers can be readily performed. Since the inner space of vessel 7 is divided only by partition member 2, dead space as shown in the prior art of FIG. 2 is eliminated, the effective beam emitting area as seen from light beam transmitting end 1*a* is increased, and colour noise is reduced accordingly. Since the inner space of vessel 7 is optically closed from cathode 4, the light around the cathode is not observed from the light beam transmitting end. Therefore, the recognition of the colour display can be further enhanced.

In FIG. 3, three parallel discharge paths may be provided, and red, blue and green colour beam emitting fluorescent material layers may be formed. Or, four or more parallel discharge paths may be provided, and at least red, blue, green colour beam emitting fluorescent material layers may be formed. A common discharge current passing hole may be formed at closing plate 7*a* of vessel 7, and discharge current passing holes 8*a* to 8*d* of the side may be omitted.

Figure 5:
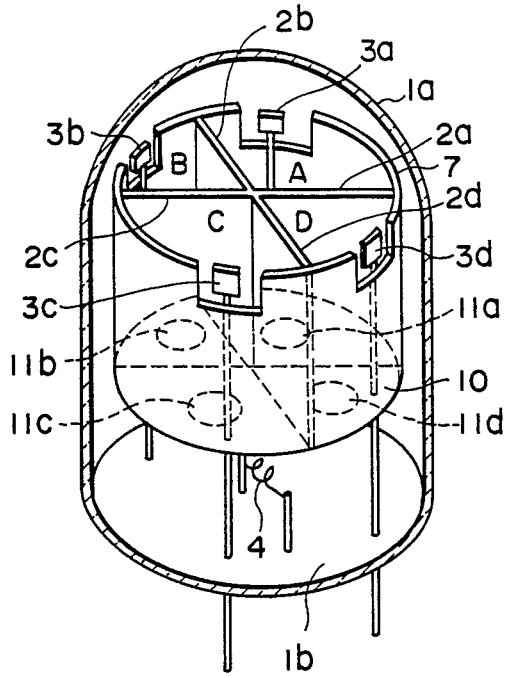
FIG. 5 is a perspective view showing partly in section the inner structure of a fluorescent lamp according to a second embodiment of the present invention.

In the second embodiment shown in FIG. 5, vessel 7 is of a cylinder type having an open end and bottom plate 10 at the electrode sealing end side. Bottom plate 10 is provided with discharge current passing holes 11*a* to 11*d* corresponding to parallel discharge paths A to D. The inner surfaces of parallel discharge paths A, B, C, D are coated with green, blue, green and red colour fluorescent material layers, respectively. The fluorescent material layers are also provided on the inner surface of bottom plate 10 inclined with respect to a center axis of envelope 1 to provide the same advantages as those of the first embodiment shown in FIG. 3. The same reference numerals as in the first embodiment in FIG. 3 are employed on the same parts in the second embodiment, and the detailed description thereof will be omitted.

Figure 6:
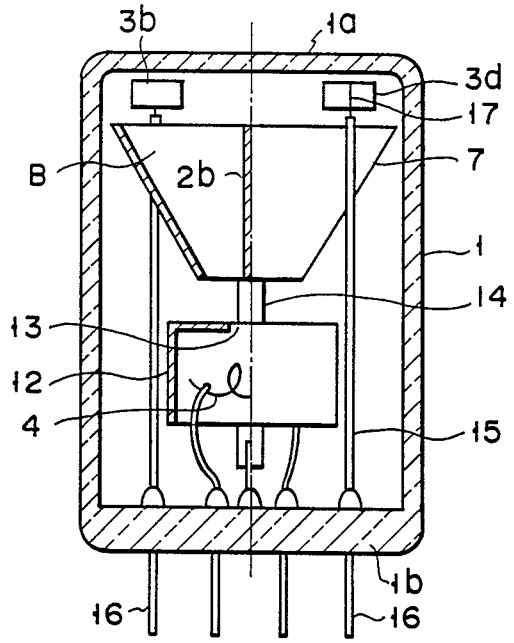
FIG. 6 is a partially longitudinal sectional view of a fluorescent lamp of a third embodiment of the present invention.

In the third embodiment shown in FIG. 6, cathode glow-spread preventing structure 12 (which is a structure for preventing a discharge around cathode 4 from laterally spreading) is provided between discharge path forming structure (7, 2) and cathode filament 4. When a discharge is generated between cathode 4 and selected anode such as 3*a*, a glow discharge region is generated around cathode 4. A visible light generated from the glow discharge region becomes a colour noise, and an ultraviolet ray generated from the glow discharge region must be prevented from being guided as stray light beams to parallel discharge paths B, C, D, except parallel discharge path A, to energize the fluorescent material layers in discharge paths B, C, D to generate undesired colour to become a colour noise. In FIG. 6, spread preventing structure 12 is formed as a bottomed cylinder having a side surface portion surrounding the cathode and a bottom plate facing the small diameter portion of vessel 7. Discharge path hole 13 is formed at the center of the bottom plate. Supporting plate 14 supports vessel 7 and cylinder 12 as shown in FIG. 6. Anodes 3*a* to 3*d* are supported by glass sleeves 15, connected to external pins 16, and connected to conductors 17 passing sleeve 15. Mercury and rare gas are sealed in envelope 1. Green, blue, green and red colour beam emitting fluorescent layers are respectively coated on the inner surfaces parallel discharge paths A, B, C, D similarly to the first embodiment shown in FIG. 3.

Figure 7:
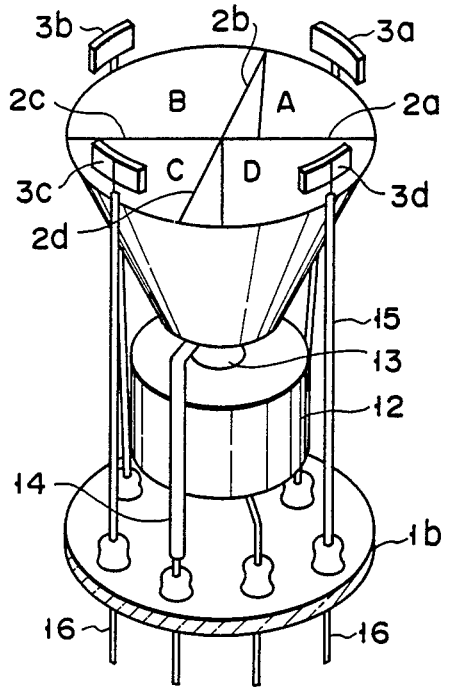
FIG. 7 is a perspective view of the inner structure of FIG. 6.

When a discharge is generated, for example, between cathode 4 and anode 3*a*, i.e., in parallel discharge path A in FIGS. 6 and 7, the spread of the cathode glow discharge region generated around cathode 4 is limited by the inner surface of cylinder 12. In other words, the inner diameter of the cathode glow discharge region between vessel 7 and cylinder 12 is reduced to a desired value by center hole 13 of cylinder 12. Thus, since the fluorescent material layers in parallel discharge paths B, C, D are not energized by the discharge around cathode 4, i.e., by an ultraviolet ray, for example, generated from the cathode glow discharge region, colour noise is decreased. If spread preventing structure 12 is not provided, when light beam transmitting end 1*a* is observed from above the center axis of envelope 1, the red colour light from heated cathode 4 and blue colour light based on the discharge around cathode are observed. However, the red and blue colour lights are interrupted from a visual field on the center axis by providing the spread preventing structure 12. According to this embodiment, to prevent the discharge around the cathode from spreading, it is not necessary to bend the parallel discharge path. Therefore, it can prevent the lamp effects from decreasing or the discharge starting voltage from increasing.

In the embodiment shown in FIGS. 6 and 7, anodes 3*a* to 3*d* are disposed at the open end of the larger diameter portion of vessel 7, i.e., at the position in contact with the inner surface of envelope 1. Therefore, when the light transmitting end is observed from the extension of the center axis, the anodes do not disturb the observation of the inner surface of vessel 7, resulting in decreasing the colour noise. In this case, since a discharge arc passes the vicinity of the inner surface of vessel 7, it strongly energizes the fluorescent material layer on the inner surface to improve the visibility.

Figure 8:
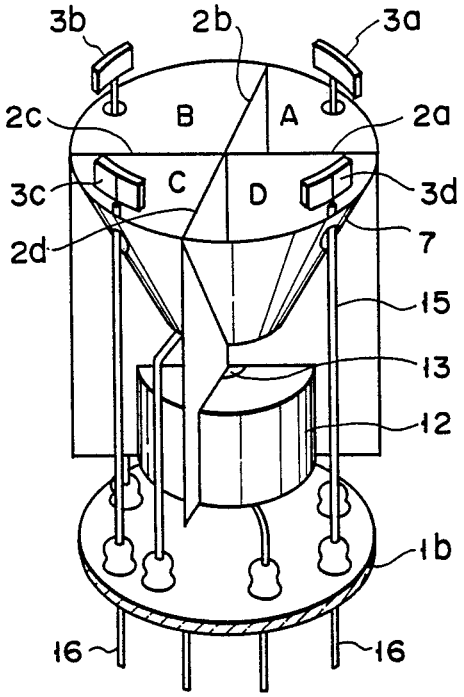
FIG. 8 is a perspective view showing partly in section the inner structure of a fourth embodiment of the present invention.

A fourth embodiment of the invention shown in FIG. 8 discloses means for guiding a discharge around the cathode, i.e., a cathode glow is further effectively limited only to a selected parallel discharge path, causing only a selected parallel discharge path to be energized without colour noise. Since the fourth embodiment shown in FIG. 8 is different from the third embodiment shown in FIG. 6 at portions 2*a* to 2*d* of the partition member, the same reference numerals as in the third embodiment in FIG. 6 denote the same parts in the fourth embodiment, and the entire description will be omitted. Portions 2*a* to 2*d* of the partition member are extended at least to discharge passing hole 13 of cathode glow-spread preventing structure 12 through the outer wall of vessel 7. As shown in FIG. 8, portions 2*a* to 2*d* of the partition member may be further extended in contact with the outer periphery of spread-preventing structure 12.

According to the fourth embodiment, when a discharge is generated between cathode 4 and a selected anode, as has already been described with reference to FIG. 6, the cathode glow generated around the cathode is prevented from laterally spreading by spread preventing structure 12. In the embodiment shown in FIG. 8, the cathode glow flowing out from discharge passing hole 13 of spread preventing structure 12 is guided only to a parallel discharge path having a selectec anode, by portions 2*a* to 2*d* of the partition members to form a positive column in the selected discharge path, thereby generating an ultraviolet ray from the positive column. This ultraviolet ray excites the fluorescent material layer of the selected discharge path to generate a desired colour beam. Since the cathode glow is not guided to the parallel path of a not selected anode, light emitted from a not selected parallel discharge path is effectively prevented and colour noised decreased. In the fourth embodiment, part of the selected parallel discharge path is not interrupted by a shield to decrease the light emitting area of the parallel discharge path and the discharge starting voltage is not increased by bending the discharge path.

In the fourth embodiment described above, the extended portions of portions 2*a* to 2*d* of the partition member which are externally extended from vessel 7 are not coated with fluorescent material layers. Therefore, even if the cathode glow is leaked from discharge passing hole 13 in a direction of of not selected (other) parallel discharge path, as the extended portions of the partition member are not coated with fluorescent material layers, the conversion of an ultraviolet ray to a visible ray is not conducted at the extended portions. As described above, the fourth embodiment is adapted for colour display elements which can largely decrease colour noises. Since anodes 3*a* to 3*d* of this fourth embodiment are disposed at the open end of the larger diameter portion of vessel 7, i.e., at the position contacted with the inside of envelope 1 in the same manner as the third embodiment shown in FIGS. 6 and 7, the anodes are prevented from becoming the cause of colour noise. Further, since the discharge arc passes the vicinity of the inner surface of vessel 7, it strongly energized the fluorescent material on the inner surface of the vessel, thereby improving the visilibity of the display.

Figure 9:
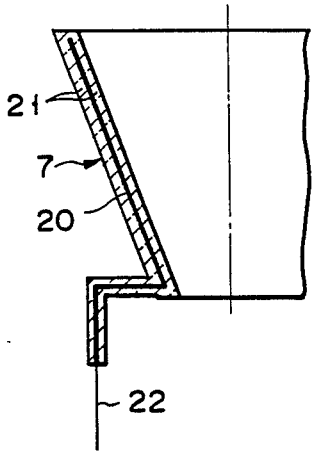
FIG. 9 is a sectional view of a vessel of a discharge path forming structure of a fifth embodiment of the present ivnention.

A fifth embodiment of the present invention is shown in FIG. 9. Since the fifth embodiment is modified only with respect to vessel 7 of the third embodiment shown in FIG. 6, a description of the parts except those shown in FIG. 9 will be omitted. In FIG. 9, vessel 7 is coated with glass 21 on both side surfaces of metal frame 20. Feeding wire 22 is connected to metal frame 20, the feeding wire is guided from electrode sealing end 1*b*, and a predetermined voltage is applied to the feeding wire. When a predetermined voltage is applied to feeding wire 22, an electric field is formed in parallel discharge paths A, B, C, D, and the parallel discharge paths are ionized. Therefore, the discharge starting voltage is decreased between cathode 4 and anodes 3*a* to 3*d*. Glass layer 21 prevents impurity gas from metal frame 20 from discharging. Though not shown, the partition member may be formed of a metal plate, and both side surfaces of the metal plate may be coated with a glass layer. A predetermined voltage may be applied to the metal plate. Ceramics may be used instead of the glass layer.

Figure 10:
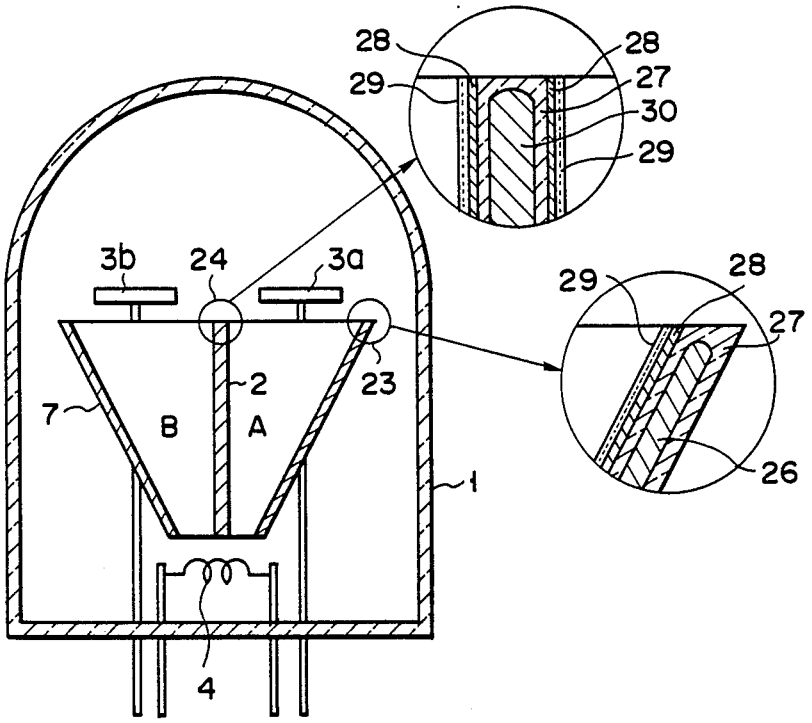
FIG. 10 is a partially sectional view of a sixth embodiment of the present invention.

In a sixth embodment shown in FIG. 10, modified examples of vessel 7 and partition member 2 are disclosed. An enlarged sectional view of portion 23 of vessel 7, and an enlarged sectional view of portion 24 of partition member 2 are simultaneously shown. In the enlarged sectional view of portion 23, a fritted glass is, for example, seized on Ni frame to form glass film 27. Reflection film 28 such as an aluminum film is formed by baking on glass film 27 on the inner surface of vessel 7. Fluorescent material layer 29 is formed by seizing on reflection film 28. In the enlarged sectional view of portion 24, fritted glass is, for example, seized on both side surfaces of Ni plate 30. In the abovedescribed structure, an aluminum reflection film 28 is, for example, formed on glass film 27 and fluorescent material layer 29 is formed by seizing on reflection film 28. However metal frame 26 and metal partition member 30 may be oxidized in advance to prevent them from corroding before forming the glass films thereon. It is, of course, natural that the light emitting characteristics of fluorescent material layers in the same parallel discharge paths must be the same.

In the sixth embodiment described above, metal frame 26 and metal partition member 30 are coated with glass film 27. Therefore, after the lamp is completed, impurity gas is not discharged from the metal frame and the metal partition member to eliminate the reduction in the life of the lamp based on the impurity gas. Metal frame 26 and metal partition member 30 may be used as an auxiliary electrode for generating an electric field. However, even in this case, as it is coated with glass film 27, no discharge is generated between the auxiliary electrode and another electrode.

Figure 11:
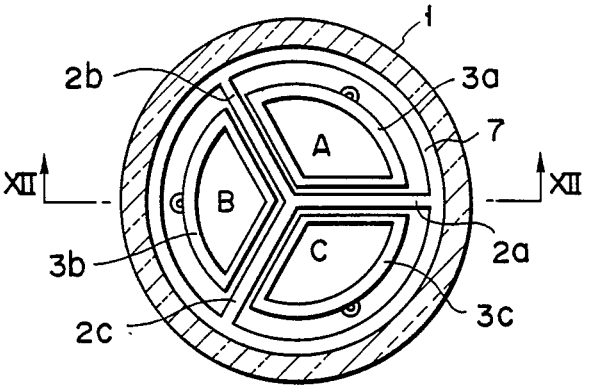
FIG. 11 is a partially sectional view of a seventh embodiment of the invention.
Figure 12:
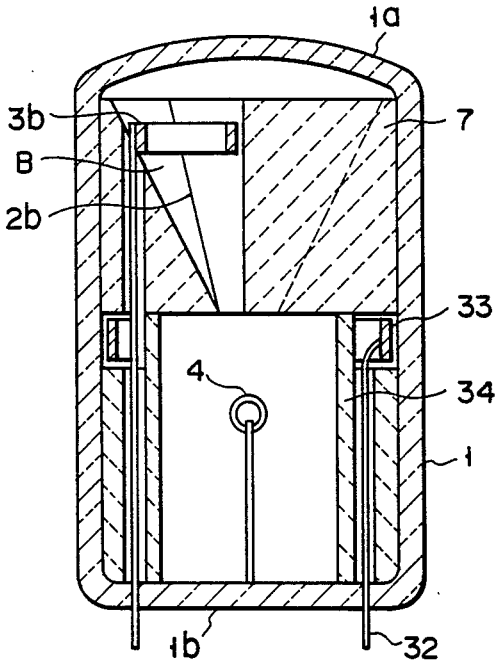
FIG. 12 is a longitudinal sectional view taken along the line XII—XII of FIG. 11.

FIGS. 11 and 12 show a seventh embodiment of the invention. In this seventh embodiment, vessel 7 and partition member 2 are integrally composed of ceramics with three parallel discharge paths A, B, C. Supporting structure 34 for supporting vessel 7 and surrounding cathode 4 is also composed of ceramics. Parallel discharge path A for generating a green colour beam, parallel discharge path B for generating a blue colour beam and parallel discharge path C for generating a red colour beam are provided. The inner surface of vessel 7 in parallel discharge path A and the surfaces of portions 2*a*,.2*b* of the partition member are coated with fluorescent material layers for emitting a green colour beam. The inner surface of vessel 7 in parallel discharge path B and the surfaces of portions 2*b*, 2*c* of the partition member are coated with fluorescent material layers for emitting a blue colour beam. The inner surface of vessel 7 in parallel discharge path C and the inner surfaces of portions 2*c*, 2*a* of the partition member are coated with fluorescent material layer for emitting a red colour beam. When light beam transmitting end 1*a* is directly observed from above the center axis of envelope 1, it is necessary to increase the areas of fluorescent material layers coated on the inner surface of vessel 7 to be directly observed as large as possible. Thus, the diameter of truncated portion of vessel 7 at the cathode side is formed as small as possible. More specifically, the cross sectional area of the discharge path at the smaller diameter portion is reduced. In this discharge path, a voltage which must be applied between the cathode and the anode is raised. Therefore, since the discharge starting voltage is raised, it is hardly started. It is necessary to apply a high voltage between the anode and the cathode to start the discharge. It is known to provide an auxiliary electrode or an ionization electrode to decrease the discharge starting voltage. However, when using the multicolor fluorescent lamp of the invention for a display device, the above-described auxiliary electrode must be, for example, energized even if a discharge is not formed between a cathode and an anode during a deenergization period. Thus, the fluorescent material layer is energized to emit a light even during the discharge stopping period. When a ionization electrode is provided in each parallel discharge path, the discharge starting voltages are different at the respective parallel discharge paths, and a clear display cannot be obtained. Therefore, in this embodiment, a ring-like ionization electrode 33 is provided to commonly surround the parallel discharge paths at the sapce between cathode 4 and vessel 7. This ionization electrode is arranged to be applied with a voltage through pin 32 as shown in FIG. 12.

In the seventh embodiment described above, an ionized state is formed between cathode 4 and anodes 3a to 3*c* by the ring-like ionization electrode 33 without any adverse influence to the discharge of each parallel discharge path to decrease the discharge starting voltage. Further, the ionization can prevent the fluorescent material layer from being energized to emit a light at deenergization time. In addition, the discharge starting voltages of the respective parallel discharge paths can be made uniform.

Figure 13:
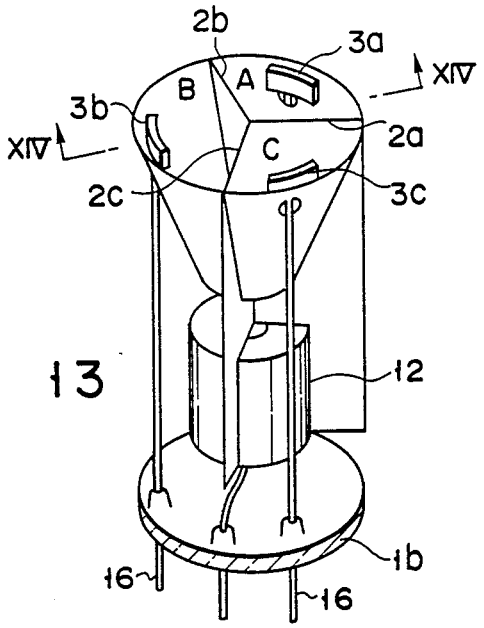
FIG. 13 is a partially sectional perspective view of an eighth embodiment of the invention.
Figure 14:
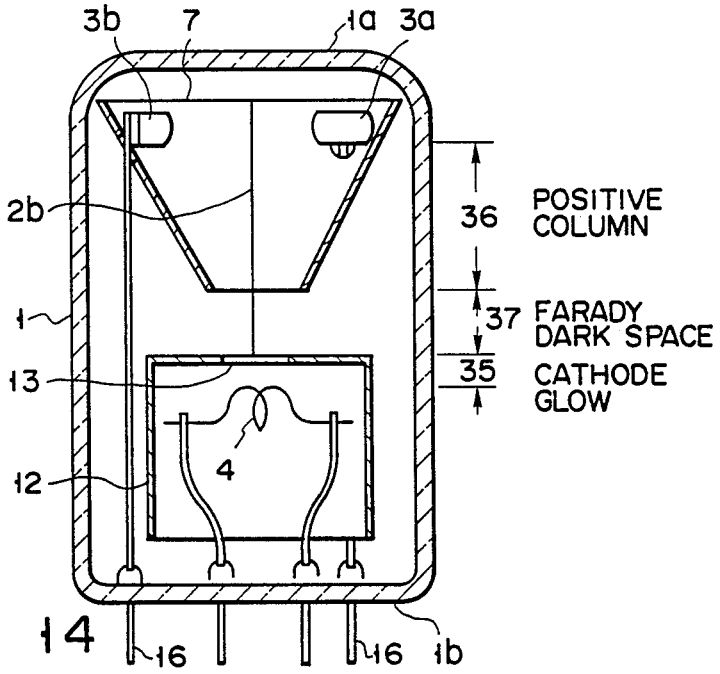
FIG. 14 is a longitudinal sectional view taken along the line XIV—XIV of FIG. 13.

An eighth embodiment is shown in FIGS. 13 and 14. The eighth embodiment is different from the fourth embodiment shown in FIG. 8 in that the eighth embodiment includes portions 2*a*, 2*b*, 2*c* of the partition member, three parallel discharge paths A, B, C and that a relation among the lengths of the cathode glow, Farady space and positive column formed in the discharge path; distance between cathode 4 and discharge passing hole 13 of cathode glow-spread preventing structure 12; and the height of vessel 7 are defined. It has been already described with respect to the third embodiment shown in FIG. 6 that, to emit a monochromatic light beam, it is necessary to prevent the cathode glow from spreading in an undesired parallel discharge path by preventing the negative glow from spreading at the periphery of the cathode. To achieve this object, in FIG. 14, the distance 35 between the upper end of cathode 4 and discharge passing hole 13 is made longer than the cathode glow and the effective height of vessel 7 (ths distance between the lower end of anode 3*a* and the lower end of vessel 7 in FIG. 14) is made longer than the length of the positive column. Thus, it can prevent the cathode glow from spreading to the undesired parallel discharge path and can effectively utilize an untraviolet ray generated from the positive column to energize the fluorescent material layer.

Figure 15:
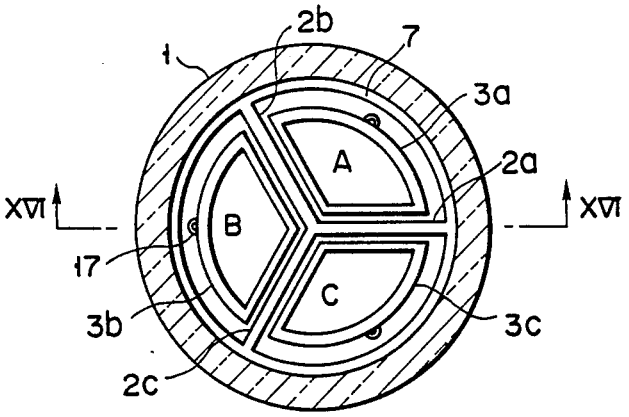
FIG. 15 is a partially sectional plan view of a ninth embodiment of the invention.
Figure 16:
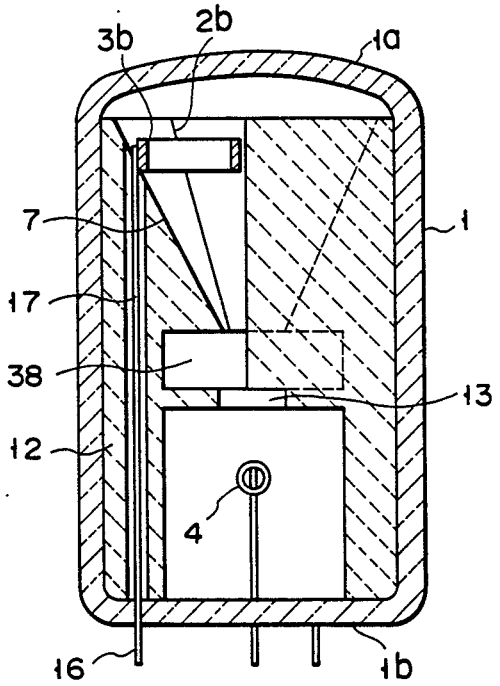
FIG. 16 is a longitudinal sectional view taken along the line XVI—XVI of FIG. 15.

In the ninth embodiment of the invention shown in FIGS. 15 and 16, vessel 7, partition member 2 and cathode glowspread preventing structure 12 are made into one united body with ceramics. Air space 38 for Farady dark space (corresponding to 37 in FIG. 14) is formed between the lower portion of vessel 7 and cathode glow spread preventing structure 12. This air space 38 is disposed adjacent to discharge passing hole 13 of cathode glow spread preventing structure 12. The description of envelope 1, parallel discharge paths A, B, C, anodes 3a to 3*c* and cathode 4 will be omitted, since they are similar to those in the previous embodiments.

When vessel 7 and partition member 2 are formed of metal, since the thermal capacity of the metal is small, temperature change rates (change of temperature per unit time) increases at between fluorescent lamp energizing time and fluorescent lamp deenergizing time. In other words, the temperatures in the fluorescent lamp become unstable. As a result, mercury vapor pressure in the lamp (determined by the portion of the lowest temperature) becomes unstable. Therefore, the electrical characteristics and the light output of the lamp become unstable. Particularly in a display device associated with a number of lamps, lamps heated by energization and lamps deenergized exist in the mixture. Thus, when these lamps are fired simultaneously, intensity difference, colour irregularity, color displacements are observed among the lamps. Further, oxygen is discharged as impurity gas from the metal surface at the baking time (approx. 500° C.) when the fluorescent material layers are formed on the predetermined inner surfaces of the parallel discharge paths to deteriorate the light outputs and the electrical characteristics of the lamp.

However, in the ninth embodiment described above, the above-mentioned parallel discharge paths are all formed of ceramics having larger thermal capacity and thermal resistance than the metal. Therefore, the above-described drawbacks can be all eliminated. Since the thermal capacity is large, the temperature is stabilized, and therefore the electrical characteristics and the light output are stabilized in the fluorescent lamp. When a display device is composed of the fluorescent lamps, colour irregularity and displacement can be suppressed.

In the ninth embodiment described above, the cathode glow-spread preventing structure 12 is made into a united body with the ceramics. This is to further stabilize the temperature in the fluorescent lamp and the electrical characteristics and the light output of the fluorescent lamp by suppressing the temperature change around cathode 4 to a small range and to reduce the number of parts and the number of assembling steps. Even if spread preventing structure 12 is formed of metal as shown in FIG. 6 and vessel 7 and partition member 2 are made into a united body with ceramics as shown in FIGS. 15 and 16, the same advantages as those in the ninth embodiment can be provided.

Figure 17:
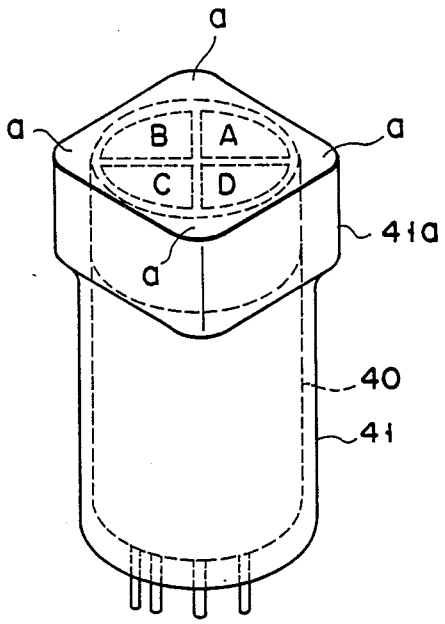
FIG. 17 is a perspective view of a tenth embodiment of the invention.

FIG. 17 shows a tenth embodiment of the invention having an envelope including an air space for condensing mercury vapour. In FIG. 17, portion 41*a* having projecting space "a" is formed at light beam transmitting end side of envelope 41. A discharge body in which the vessel, partition member and cathode glow spread preventing structure are made into a united body with ceramics is designated by reference numeral 40. This embodiment is shown to have four parallel discharge paths A, B, C, D. As described above, discharge gas such as, for example, mercury and rare gas are sealed in the envelope. When envelope 41 is composed like envelope 1 in FIG. 16, light beam emitting end 1a, i.e., display surface is cooled. Therefore, the mercury is condensed on the inner surface of the emitting end. This condensed Hg layer absorbs the light to not only reduce the lamp efficienty but also hardly controls the colour due to the aborption of the light. However, as shown in FIG. 17, when projected portion 41*a* is formed and projecting space "a" is formed, the mercury is not condensed on the inner surface of the light beam transmitting end, but is condensed in the projecting space "a". Therefore, it can prevent the light from being absorbed and the lamp efficiency from decreasing to satisfactorily perform the display colour control.

What is claimed is:

1. A fluorescent lamp generating different color light beams, comprising:

an envelope enclosing therein a discharge substance;

first and second electrode means spatially arranged in said envelope for providing a discharge therebetween;

a discharge path-forming structure comprising a vessel located between said first electrode means and said second electrode means, said vessel having a first open end adjacent to said first electrode means and a second open end which has a diameter smaller than that of said first open end, and a dividing element for dividing an inner area defined by an inner surface of said vessel to form a plurality of divided discharge paths developed between said first and second electrode means; and a fluorescent material layer coated on said inner surface of said vessel.

2. A fluorescent lamp according to claim 1, wherein said first electrode means comprises a plurality of electrodes each corresponding to one of said divided discharge paths.

3. A fluorescent lamp according to claim 2, wherein said fluorescent material layer comprises a plurality of different fluorescent material layers, each being coated on the inner surfce of a corresponding one of said divided discharge paths, in such a way that different colour light beams are generated at said divided. discharge paths.

4. A fluorescent lamp according to claim 1, wherein said vessel has a truncated cone shape inner surface portion.

5. A fluorescent lamp according to claim 1, wherein a glow discharge-spread prevention structure is provided between the discharge inlet of said discharge path-forming structure and said second electrode means, said prevention structure having means for preventing said glow discharge from spreading over to a non-selected divided discharge path.

6. A fluorescent lamp according to claim 5, wherein said glow discharge-spread prevention structure comprises a side wall surrounding said second electrode means and an upper wall having a discharge outlet which faces said discharge inlet of said discharge path-forming structure, and wherein said dividing element is extended at least to said discharge outlet.

7. A fluorescent lamp according to claim 6, wherein said extended portion of said dividing element is not coated with said fluorescent material layer.

8. A fluorescent lamp according to claim 1, wherein said vessel is made of an electrical conductor connected to a feeding wire for supplying a voltage to said vessel.

9. A fluorescent lamp according to claim 1, wherein said vessel is made of an electrical conductor and a ceramic insulating layer coated on both sides of said electrical condutor.

10. A fluorescent lamp according to claim 1, wherein a fluorescent material layer is provided on said dividing element, said fluorescent material layer on said dividing element and said fluorescent material layer on said inner surface of said vessel being the same at the same divided discharge path in their luminous characteristics.

11. A fluorescent lamp according to claim 10, wherein said fluorescent material layer on said dividing element is provided on a reflection layer formed on a base plate constituting said dividing element.

12. A fluorescent lamp according to claim 1, wherein said vessel and said dividing element are made into a united body formed of a ceramic material.

13. A fluorescent lamp according to claim 1, wherein an ionization electrode is provided so as to surround a side region in a space between said discharge path-forming structure and said second electrode means.

14. A fluorescent lamp according to claim 1, wherein a glow discharge-spread prevention structure for said second electrode means has a side wall surrounding said second electrode means, and a top wall having a discharge outlet; the distance between the top portion of said second electrode means and said discharge outlet is determined to be longer than the length of a glow discharge of said second electrode means; and the vertical distance between a discharge inlet of said discharge path-forming structure and said first electrode means is determined to be longer than the length of a positive column.

15. A fluorescent lamp according to claim 5, wherein said discharge path-forming structure and said glow discharge-spread prevention structure are made into one united body formed of a ceramic material.

* * * * *